US007213426B2

(12) United States Patent
Qing

(10) Patent No.: US 7,213,426 B2
(45) Date of Patent: May 8, 2007

(54) STORM DOOR MORTISE LOCK THAT PREVENTS LOCKOUT

(75) Inventor: Wu Feng Qing, Chong Xing Town (CN)

(73) Assignee: Betteli, Inc. Hong Kong, Hong Kong (HK)

( * ) Notice: Subject to any disclaimer, the term of this patent is extended or adjusted under 35 U.S.C. 154(b) by 0 days.

(21) Appl. No.: 10/730,858

(22) Filed: Dec. 9, 2003

(65) Prior Publication Data

US 2005/0092041 A1 May 5, 2005

Related U.S. Application Data

(60) Provisional application No. 60/515,857, filed on Oct. 30, 2003.

(51) Int. Cl.
*E05B 59/00* (2006.01)
*E05B 63/14* (2006.01)

(52) U.S. Cl. ..... 70/107; 70/134; 70/379 R; 70/380; 70/DIG. 52; 292/139; 292/140; 292/152; 292/DIG. 41; 292/DIG. 52; 292/DIG. 61

(58) Field of Classification Search ..... 70/81, 70/DIG. 52, 107, 108–111, 134, 379 R, 379 A, 70/380, DIG. 6, DIG. 66; 292/209, 204, 292/152, 139, 140, DIG. 61, DIG. 41, DIG. 52
See application file for complete search history.

(56) References Cited

U.S. PATENT DOCUMENTS 688,491 A * 12/1901 Sigler ..... 292/204
1,378,518 A * 5/1921 Boardman ..... 5/100
1,841,890 A * 1/1932 Hannon ..... 292/204
3,141,319 A * 7/1964 Schlage ..... 70/81
3,589,152 A * 6/1971 Glass et al. ..... 70/81
3,759,074 A * 9/1973 Prahl ..... 70/143
3,762,750 A * 10/1973 Orr ..... 292/140
3,884,056 A * 5/1975 East et al. ..... 70/100
4,470,276 A * 9/1984 Bayless ..... 70/91
4,489,576 A * 12/1984 Mullich et al. ..... 70/134
4,561,684 A * 12/1985 Marotto ..... 292/150
4,664,433 A * 5/1987 Solovieff ..... 292/337
4,683,733 A * 8/1987 Marin ..... 70/134
4,840,050 A * 6/1989 Gotanda ..... 70/107
4,986,576 A * 1/1991 Anderson ..... 292/40
5,176,416 A * 1/1993 Lin ..... 292/143
5,551,264 A * 9/1996 Fann et al. ..... 70/134
5,758,527 A * 6/1998 Crepinsek ..... 70/379 R
6,164,099 A * 12/2000 Sh ..... 70/134
6,688,063 B1 * 2/2004 Lee et al. ..... 52/455

(Continued)

*Primary Examiner*—Lloyd A. Gall
(74) *Attorney, Agent, or Firm*—McKee, Voorhees & Sease, P.L.C.

(57) ABSTRACT

A method and apparatus for providing a storm door mortise lock that prevents lockout with a lock body having opposed side plates and a cam in between the side plates, the cam being in operative interaction with a dead bolt assembly. The mortise lock body also may include one or more stops within the deadbolt assembly to limit the rotation of the cam and prevent a lockout situation. A thumb turn button and key cylinder are secured to opposite escutcheon plates. A spindle traverses from the key cylinder through the cam through hole and terminates in the mounting slot of the thumb turn button. Rotation of either the thumb turn button or the key cylinder turns the spindle and actuates the cam that actuates the dead bolt assembly.

19 Claims, 5 Drawing Sheets

U.S. PATENT DOCUMENTS 6,698,259 B2 * 3/2004 MacMillan ..... 70/134
6,739,162 B1 * 5/2004 Kondratuk ..... 70/134
2003/0033839 A1 * 2/2003 Chen et al. ..... 70/107
2003/0192355 A1 * 10/2003 Char et al. ..... 70/107

* cited by examiner

STORM DOOR MORTISE LOCK THAT PREVENTS LOCKOUT

CROSS-REFERENCE TO RELATED APPLICATIONS

This application is a non-provisional of U.S. Ser. No. 60/515,857 filed on Oct. 30, 2003.

BACKGROUND OF THE INVENTION

1. Field of the Invention

The present invention generally relates to a storm door mortise lock and more specifically to a storm door mortise lock that prevents a lockout situation.

2. Prior Art

Storm door mortise locks typically have a dead bolt that is activated by a key cylinder body having a cam. The cam is rotated by either turning a thumb turn button or by use of the correct key in the key cylinder.

The key cylinder body of the prior art created a danger that a lockout situation could occur. If the cam was over rotated, it would fall out of the notch in the dead bolt assembly and if the dead bolt assembly stopped in a position wherein the cam cannot re-enter the dead bolt. This could leave the dead bolt engaged without a means to disengage it, commonly known as a lockout situation. This would greatly inconvenience the storm door operator and possibly require the disassembly of the storm door. There is therefore a need for a mortise lock that will prevent a lockout situation.

As seen in FIG. 4, one solution of preventing a lockout situation is to provide stops to halt the forward and rearward movement of the cam. While this prevents a lockout situation, there is no biasing effect by the stops against the cam to provide a positive feedback to the user that the deadbolt is moving from an unlocked to locked position and vice versa. There is therefore a need for a spring that influences the cam to provide a positive feedback of movement.

In addition, the prior art utilized a spring on the inside of the deadbolt. This spring acted upon the cam to bias it toward the stop and out of the plane of the deadbolt. If there was a flaw in the stop such as a crack, an improperly bent stop, or improperly placed stop the spring could push the cam out of the plane of the deadbolt and cause a lockout situation. There is therefore a need for a spring located outside the deadbolt which biases the cam into the plane of the deadbolt thus preventing a lockout situation.

Still further, the prior art does not use a cam that is interconnected with the dead bolt. This lack of interconnection provides the possibility of a lockout situation as there becomes wear on the stops. In addition, during mass manufacture of the mortise lock it is important to have a rapid evaluation process of interconnectivity that results in preventing a lockout situation. Therefore, there is a need for an interconnection with the cam which prevents a lockout situation and provides for rapid evaluation during the manufacturing process to assure that a lockout situation is prevented.

There is therefore a need for a storm door with a mortise lock that avoids these and other problems.

Features of the Present Invention

A general feature of the present invention is the provision of a storm door mortise lock which overcomes the problems found in the prior art.

A still further feature of the present invention is the provision of a storm door mortise lock that includes built in stops in the deadbolt to prevent a lockout situation.

A still further feature of the present invention is the provision of a storm door mortise lock that has a spring which provides positive feedback that the deadbolt is moving from an unlocked to a locked position.

A still further feature of the present invention is the provision of a storm door mortise lock with a cam body interacting with the spring which provides positive feedback that the deadbolt is moving from an unlocked to a locked position.

A still further feature of the present invention is the provision of a storm door mortise lock that includes a spring biasing the cam inside the plane of the deadbolt.

A still further feature of the present invention is the provision of a storm door mortise lock that interconnects the deadbolt with the cam to prevent a lockout situation.

These, as well as other features and advantages of the present invention will become apparent from the following specification and claims.

BRIEF SUMMARY OF THE INVENTION

The present invention generally comprises an apparatus for providing a storm door mortise lock with lockout prevention. The mortise lock may be either a reversible mortise lock or a solid core mortise lock. The mortise lock includes a lock body having opposed side plates with a dead bolt assembly and a live bolt assembly intermediate the side plates. The bolts slide between retracted and extended positions beyond the edge of the door. A cam is also intermediate the side plates and therefore integral with the mortise lock body. The mortise lock of the present invention also includes a thumb turn button and a key cylinder that are separate from the cam. The thumb turn button and key cylinder are secured to opposite escutcheon plates. A spindle operatively links the key cylinder, cam and thumb turn button. Because these parts are separate, they can be used in storm doors of varying thicknesses by only changing the length of the spindle.

Further, the mortise lock body of the present invention includes apparatus for prevention of a lockout situation. The apparatus may include built in stops into the deadbolt. These stops prevent the cam from over rotating and resulting in a lockout situation.

A still further feature of the present invention is the provision of a storm door mortise lock that has a spring which provides positive feedback that the deadbolt is moving from an unlocked to a locked position.

A still further feature of the present invention is the provision of a storm door mortise lock with the cam body interacting with the spring which provides positive feedback that the deadbolt is moving from an unlocked to a locked position.

A still further feature of the present invention is the provision of a storm door mortise lock that includes a spring biasing the cam inside the plane of the deadbolt.

A still further feature of the present invention is the provision of a storm door mortise lock that interconnects the deadbolt with the cam to prevent a lockout situation.

These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals indicate corresponding structure throughout the several views.

DETAILED DESCRIPTION OF THE INVENTION

The present invention will be described as it applies to its preferred embodiment. It is not intended that the present invention be limited to the described embodiment. It is intended that the invention cover all modifications and alternatives which may be included within the spirit and scope of the invention.

Figure 1:
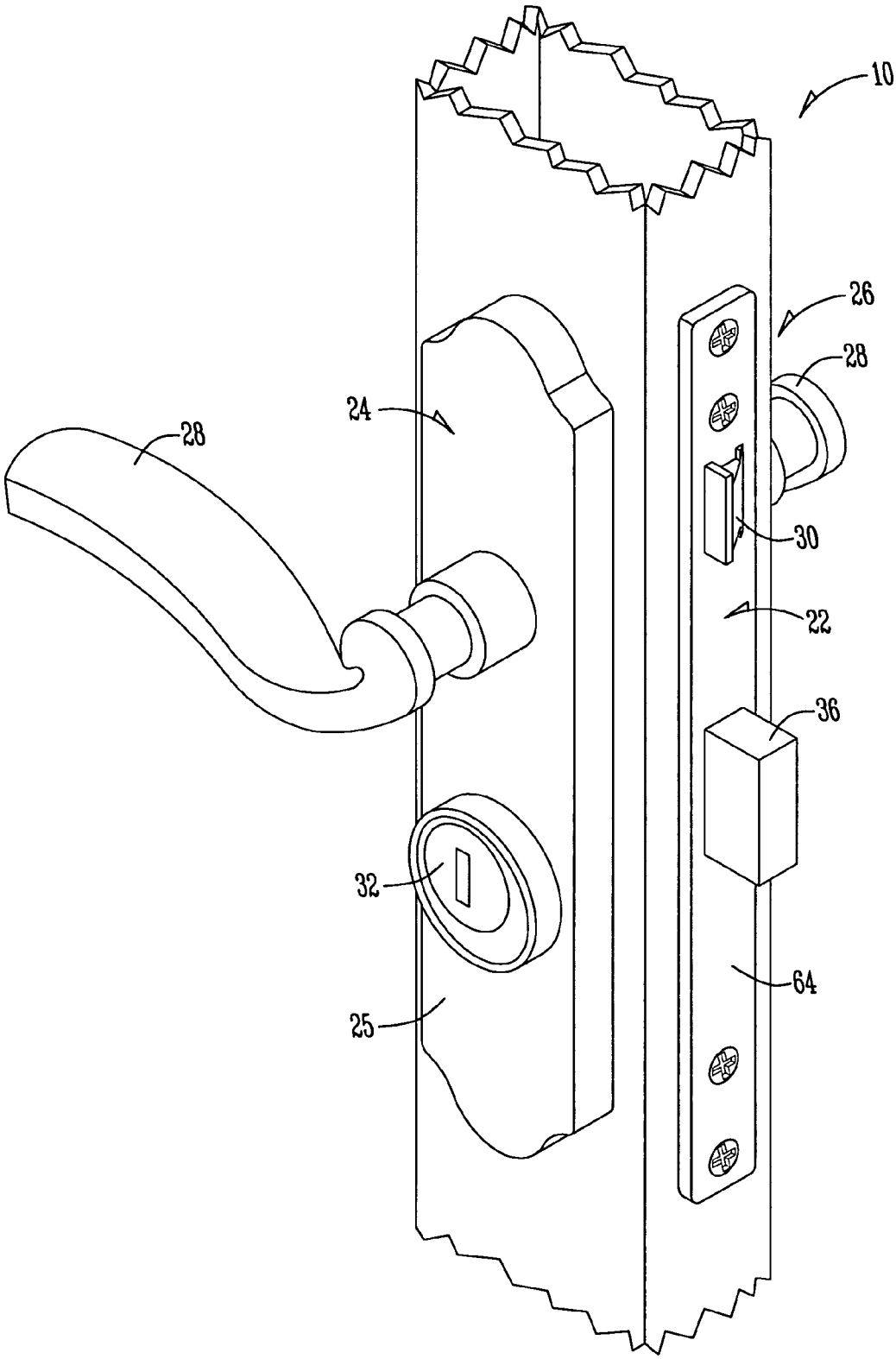
FIG. 1 is a partial perspective view of an edge of a storm door with the mortise lock of the present invention installed therein.
Figure 2:
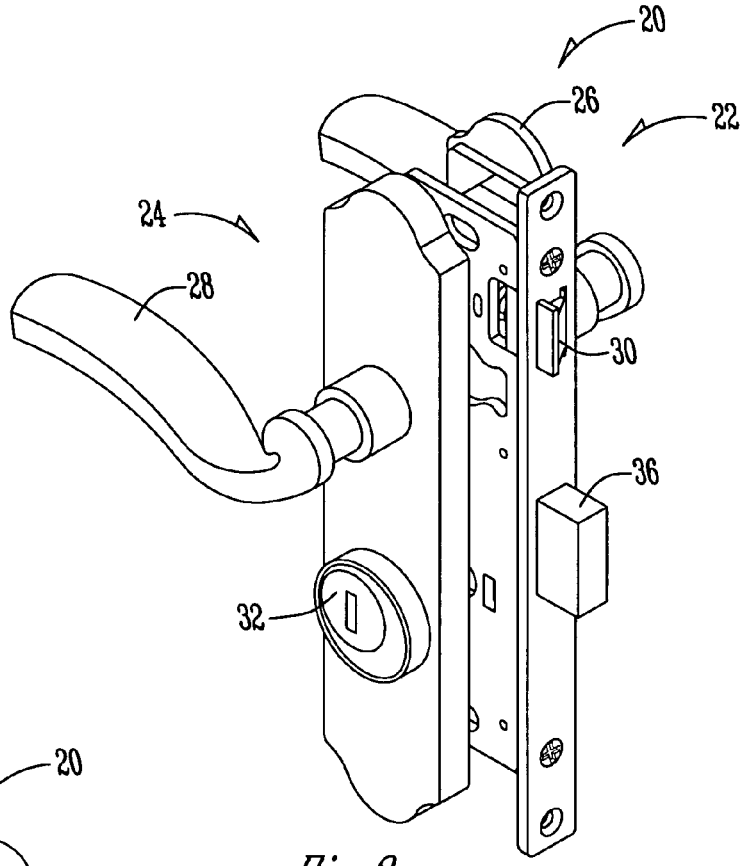
FIG. 2 is an exterior top perspective view of a mortise lock according to the principles of the present invention.
Figure 3:
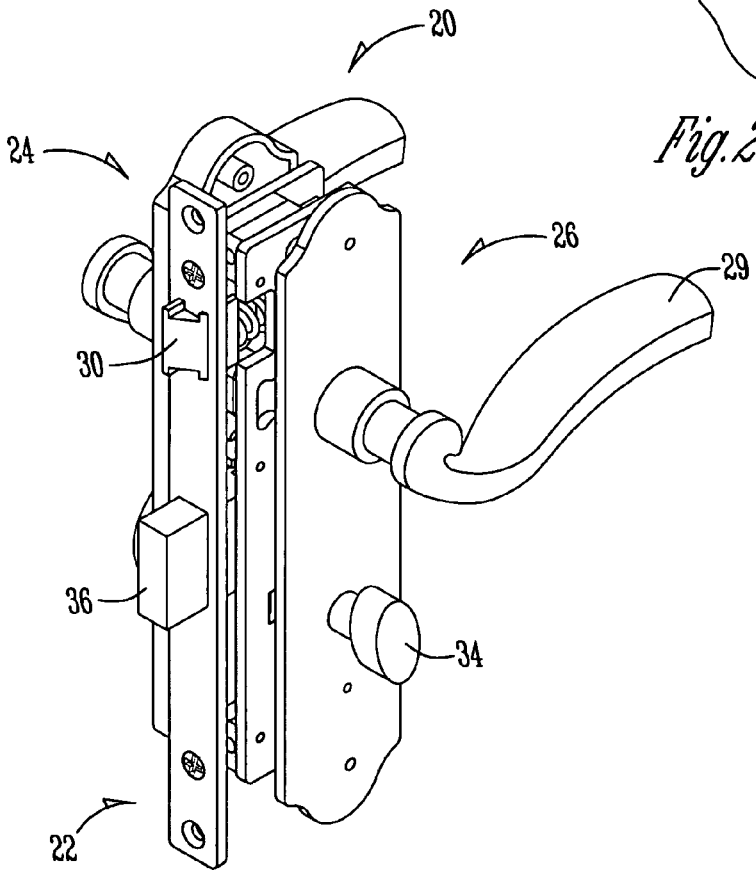
FIG. 3 is an interior top perspective view of the mortise lock shown in FIG. 2.

Referring now to the drawings, wherein like reference numerals and letters indicate corresponding structure throughout the several views, and referring in particular to FIGS. 1, 2 and 3, there is shown a storm door 10 and mortise lock 20 according to the present invention. The mortise lock 20 preferably includes a lock body 22, exterior escutcheon assembly 24 and interior escutcheon assembly 26. The exterior escutcheon assembly 24 has a handle 28 to actuate the live bolt assembly 30. The key cylinder 32, used to turn the dead bolt assembly 36, is also part of the exterior escutcheon assembly 24. The interior escutcheon assembly 26 also includes a handle 29 to actuate the live bolt assembly 30. A thumb turn button 34 is also provided to turn the dead bolt assembly 36. The live bolt assembly 30 and the dead bolt assembly 36 are secured to the lock body 22.

The key cylinder 32 of the present invention is separate from and does not include the cam 58. By separating the key cylinder 32 from the cam 58, the cross-sectional profile of the key cylinder 32 can be minimized and the thickness of the mortise lock body 22 can be minimized and can be altered to allow the lock to be placed in a door body of varying thickness. The cross-sectional profile of the key cylinder 32 is generally circular. A spindle (not shown) is rotatably secured to the key cylinder 32. The key pin or pins are incorporated within the key cylinder housing. The key cylinder 32 is secured to the exterior escutcheon plate 24. The thumb turn button 34 is preferably rotatably secured to the interior escutcheon plate 26 by a retaining ring. The thumb turn button 34 includes at least one mounting slot for receiving the spindle.

Figure 4:
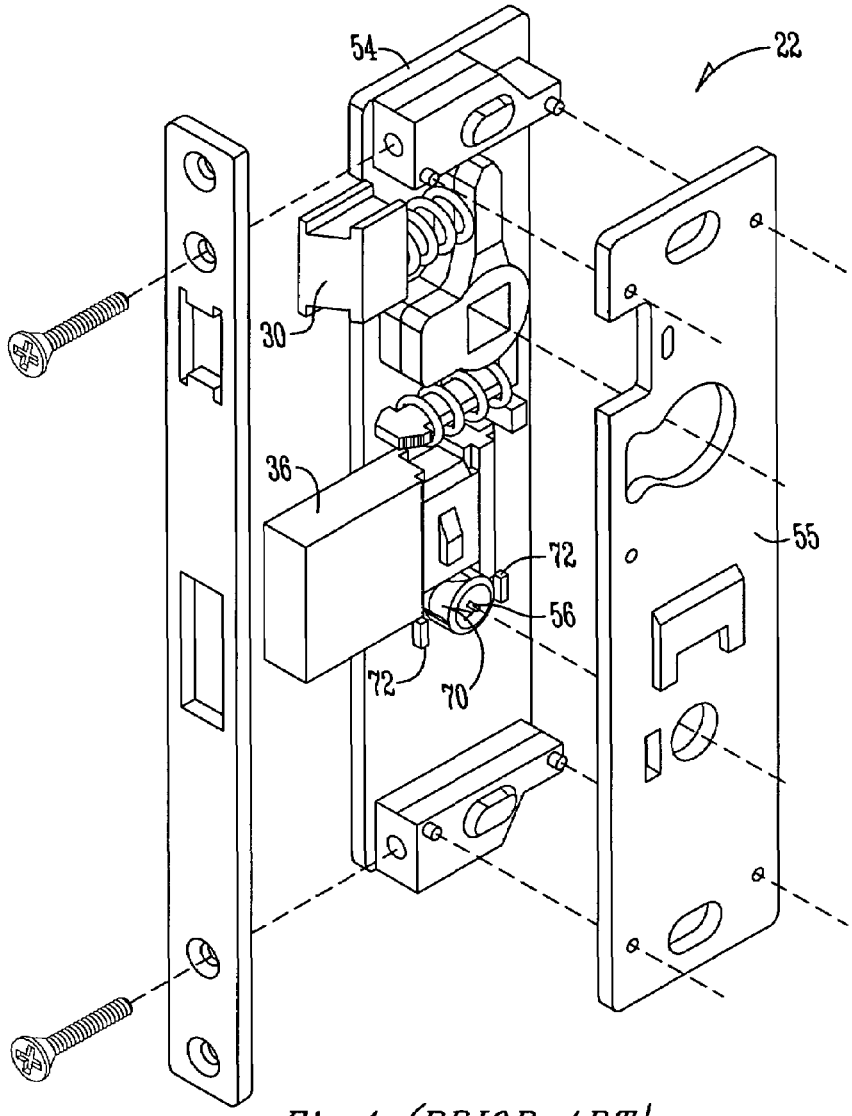
Fig. 4 (PRIOR ART)
FIG. 4 is an interior partial exploded perspective view of the mortise lock body of the prior art.
Figure 4A:
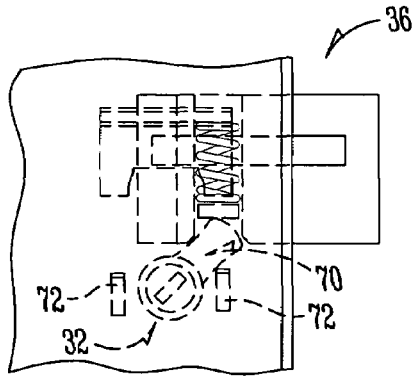
Fig. 4A (PRIOR ART)
FIG. 4A is an exterior side view of the mortise lock body of the prior art with the deadbolt assembly in a locked position.
Figure 5:
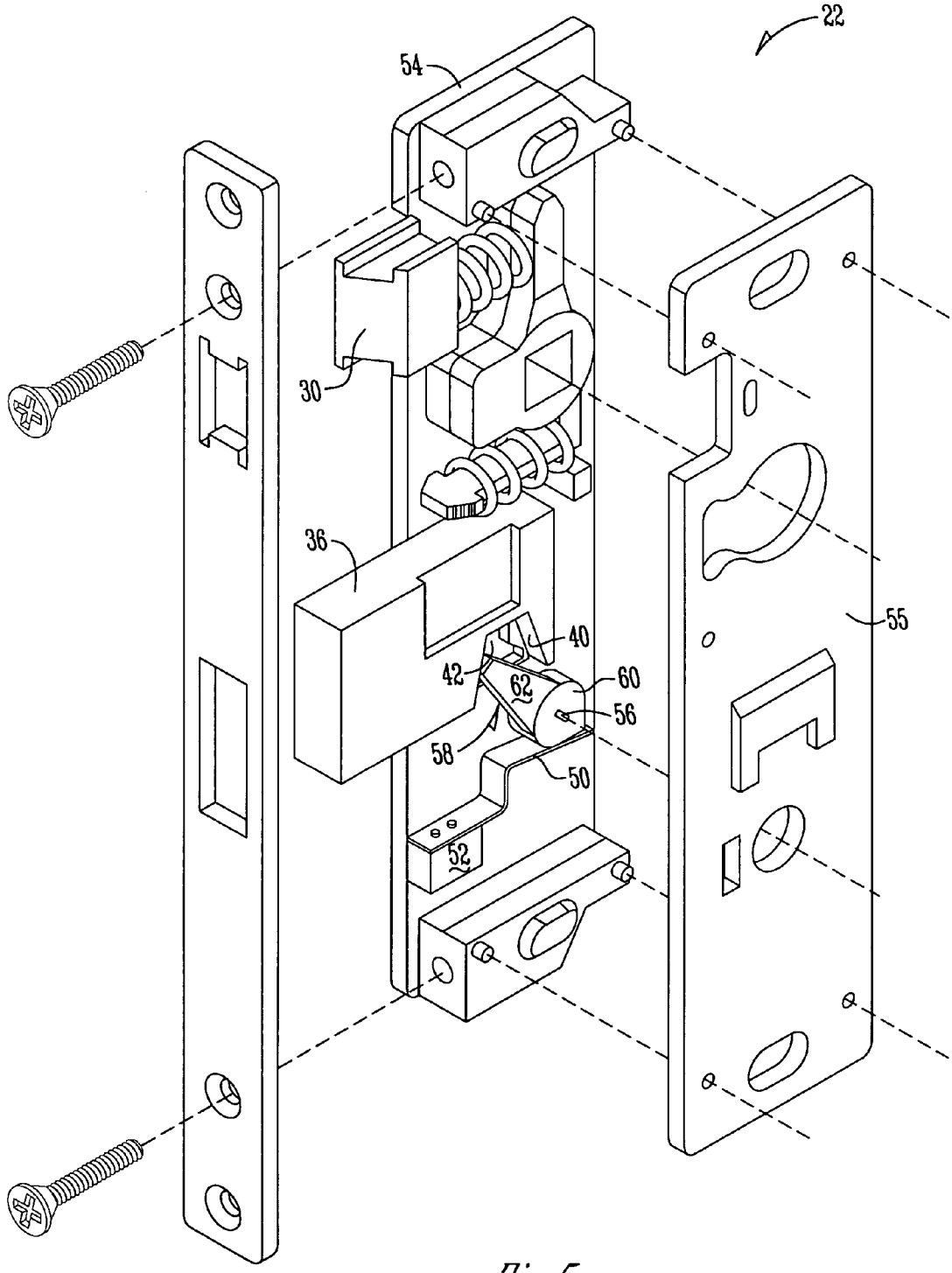
FIG. 5 is an interior partial exploded perspective view of the mortise lock body of the present invention.

The prior art lock body 22 and deadbolt assembly 36 is shown in FIG. 4 and FIG. 4A. The lock body 22 includes a cam 70 rotatably secured between two side plates 54 and 55. The cam 70 includes a through hole 56. When installed, the spindle passes through the hole 56 and into the thumb turn button 34 such that turning of either the key cylinder 32, by a corresponding key (not shown), or the thumb turn button 34 will turn the cam 70 and actuate the dead bolt assembly 36. In the prior art, rotation of the cam 70 is limited by one or more stops 72 formed in or secured to the side plates 54 and 55. These stops 72 generally prevent the cam 58 from ever losing operative interaction with the notch in the deadbolt assembly 36. In this way, the prior art prevents lockout situations.

Figure 6:
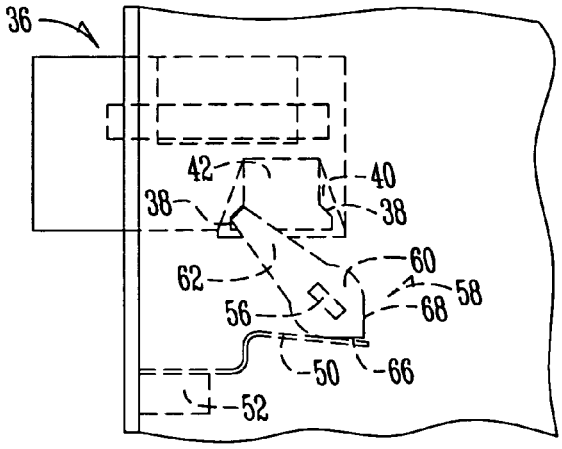
FIG. 6 is an interior side view of the mortise lock body of the present invention with the deadbolt assembly in a locked position.
Figure 7:
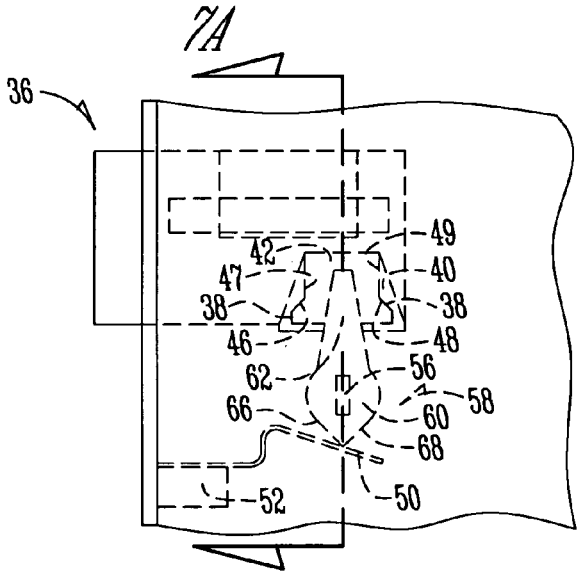
FIG. 7 is an interior side view of the mortise lock body of the present invention with the deadbolt assembly in an intermediate position.
Figure 8:
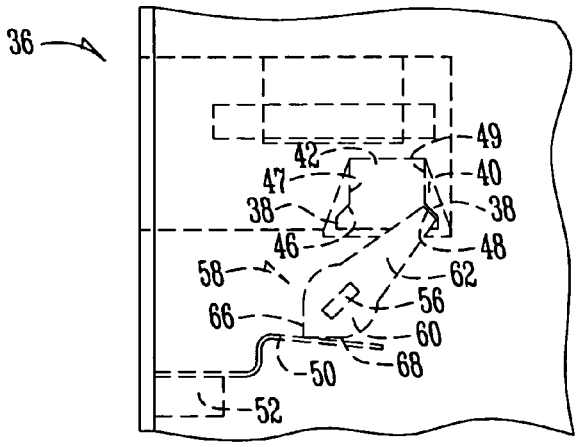
FIG. 8 is an interior side view of the mortise lock body of the present invention with the deadbolt assembly in an unlocked position.

As is shown in FIGS. 6–8, during actuation of the dead bolt assembly 36, the cam 58 of the present invention will rotate through approximately a 90 degree arc. Rotation of the cam 58 may be limited by one or more stops 38 formed in or secured to the dead bolt assembly 36. The cam generally includes a cam body 60 and a cam arm 62. The cam arm 62 extends axially from the cam body 60 and into the dead bolt assembly 36. When the cam arm 62 is rotated in one direction the dead bolt assembly 36 is extended and the storm door 10 is secured. When the cam arm 62 is rotated in the opposite direction, the dead bolt assembly 36 is retracted and the storm door may be opened. The stops 38 generally prevent the cam arm 62 from ever losing operative interaction from within the dead bolt assembly 36. This prevents lockout situations.

Additionally, a spring 50 is mounted between the side plates 54, 55 by a spring mount 52. The spring 50 biases the cam arm 62 to either an unlocked position or a locked position. As seen in FIG. 7, the cam 58 goes in a neutral position when it is approximately perpendicular to the deadbolt. This neutral position helps provide a positive feel to the user that the lock is slipping between a locked position as seen in FIG. 6 to an unlocked position as seen in FIG. 8. It is to be understood that numerous spring configurations can be used to influence the cam body 60. In this embodiment, the spring is a leaf spring attached to the side plate at only one spring end. However, an alternative embodiment may have a spring attached to the side plate at both spring ends.

Alternatively, the spring 50 may be used to limit the rotation of the cam. As seen in FIGS. 6, 7 and 8, the cam body 60 may have a first flat surface 66 and a second flat surface 68. These two pieces come to a point, as seen in FIG. 6. When the deadbolt 36 is in a locked position a first flat surface 66 is approximately parallel with a surface of the leaf spring 50. As the cam body 60 is rotated to place the lock into an intermediate position, the point between the first flat surface 66 and a second flat surface 68 presses down upon the leaf spring causing the leaf spring to exert a biasing effect upon the cam body 60. When the cam 58 is rotated through the intermediate position the biasing force from the leaf spring 50 acts upon the cam body 60 until it is flush and parallel with the second flat surface 68 of the cam body 60 as seen in FIG. 8. Thus, in this fashion the leaf spring 50 prevents the cam 58 from going past the deadbolt assembly 36 because the spring 50 is pressing against the first flat surface 66 or second flat surface 68 to keep it within the plane of the notch 40. This further prevents lockout situations.

Figure 7A:
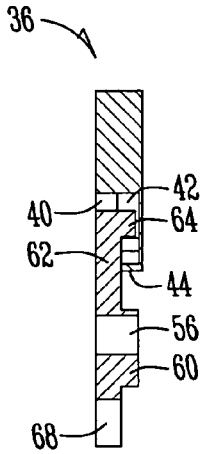
FIG. 7A is a sectional view taken along line 7A—7A of FIG. 7.

In addition, the cam 58 may have a cam finger 64 attached to the cam arm 62. The cam finger 64 provides a further tool to prevent a lockout situation by enabling the deadbolt assembly 36 and the cam 58 to be interconnected. In this embodiment, the deadbolt assembly 36 has a first notch or first notch portion 40 which permits unobstructed rotation of the cam arm 62. As shown in FIGS. 6–7 the first notch 40 is trapezoidal in shape. In addition, the deadbolt assembly 36 may have a second notch or second notch portion 42 within the first notch 40 which interacts with the cam finger 64. The cam finger 64 can be seen in FIG. 7A. The second notch 42 preferably has a closed end or lip 44 functioning as a stop that prevents the cam finger 64 from slipping out. Thus, the interaction between the cam finger 64 and the closed end 44 creates interconnectivity that prevents a lockout situation.

The second notch may also have a lock indent 46 that is approximately perpendicular to the cam finger 64 when the deadbolt assembly 36 is in the locked position that prevents closing of the deadbolt assembly 36 by means other than rotation of the key cylinder 32 or thumb turn button 34. The second notch 42 may also have an unlock indent 48 that is approximately perpendicular to the cam finger 64 when the deadbolt assembly 36 is in the unlocked position that prevents unintentional opening of the deadbolt by means other than the key cylinder 32 or the thumb turn button 34.

Finally, it should be noted that there is a vertical side 47 extending from the lock indent 46 and a vertical side 49 extending from the unlock indent 48. The juncture of the vertical side 47 with the lock indent 46 creates an obstruction such that the cam arm 62 slips over and locks into place in the lock indent 46. This locking action provides a positive feel to the user that the cam 58 is indeed in the locked position. Similarly, the vertical side 49 juncture with the unlock indent 48 creates an obstruction which when the cam arm 62 passes over provides a positive feel to the user that the deadbolt assembly 36 is in the unlocked position. It is to be understood that this positive feel of moving into the lock and unlock positions may be achieved by other forms than as illustrated in FIGS. 6–8.

A preferred embodiment of the present invention has been set forth above. It should be understood by one of ordinary skill in the art that modifications may be made in detail, especially in matters of shape, size and arrangement of parts. Such modifications are deemed to be within the scope of the present invention which is to be limited only by the broad general meaning of the terms in which the appended claims are expressed.

What is claimed is:

1. A storm door mortise lock that prevents lockout, comprising:

a pair of side plates;

a dead bolt installed between the side plates;

a cam having a cam body and a cam arm rotatably secured between the side plates and extending into a notch in the dead bolt wherein the cam body has first and second flat surfaces which converge to define an over-center point;

the cam pivoting about an axis spaced from the dead bolt;

a spring installed between the side plates and outside the dead bolt, that engages the first and second flat surface of the cam, so as to bias the dead bolt towards the locked and unlocked positions, respectively; and wherein the dead bolt having a stop to limit the rotation of the cam.

2. The storm door mortise lock of claim 1 wherein the spring further limits the rotation of the cam.

3. The storm door mortise lock of claim 1 wherein the cam includes a cam through hole.

4. The storm door mortise lock of claim 1 wherein the cam is actuated by a spindle rotatably secured to a separate key cylinder.

5. The storm door mortise lock of claim 1 wherein the cam is actuated by a spindle rotatably secured to a separate thumb turn button.

6. The storm door mortise lock of claim 1 wherein the dead bolt and cam are interconnected.

7. The storm door mortise lock of claim 1 wherein the cam has a finger extending into the dead bolt.

8. The storm door mortise lock of claim 7 wherein the dead bolt has a first notch which permits unobstructed rotation of the cam.

9. The storm door mortise lock of claim 6 wherein the dead bolt has a second notch within the first notch that interacts with the cam finger.

10. The storm door mortise lock of claim 9 wherein the second notch has a closed end that prevents the cam finger from passing into a lockout situation.

11. The storm door mortise lock of claim 9 wherein the second notch has a lock indent that is approximately perpendicular to the cam finger when the dead bolt is in a locked position that prevents unintentional closing of the dead bolt.

12. The storm door mortise lock of claim 9 wherein the second notch has an unlock indent that is approximately perpendicular to the cam finger when the dead bolt is in an unlocked position that prevent unintentional opening of the dead bolt.

13. A storm door including a mortise lock, the storm door comprising:

a door body having opposite faces and an edge, wherein the edge has a mortise formed therein;

a key cylinder operatively connected to a mortise lock;

the mortise lock inserted into the mortise, the mortise lock having:

spaced apart side plates;

a cam having an orifice engaging a first spindle operatively connected to the key cylinder, the cam being rotatably secured between the side plates and including a cam body and a cam finger wherein the cam body has converging first and second flat surfaces defining an over-center point;

a dead bolt mounted intermediate the side plates and being moveable by the cam between a locked position and an unlocked position, to receive the cam;

a live bolt slidably mounted intermediate the side plates and actuated between an extended and retracted position;

the cam having a pivot axis spaced from the dead bolt;

a spring outside the dead bolt that engages the first and second flat surface of the cam and biases the dead bolt towards the locked and unlocked positions, respectively;

a handle on each face of the door to actuate the live bolt;

the dead bolt having a notch therein and the cam finger extending into the dead bolt notch; and the notch having a lip to prevent the finger from pivoting out of the notch into a lockout situation.

14. The storm door of claim 13 wherein the notch has a first portion which permits rotation of the cam.

15. The storm door of claim 13 wherein the notch has a lock indent that is approximately perpendicular to the cam finger when the dead bolt is in the locked position.

16. The storm door of claim 13 wherein the notch has an unlock indent that is approximately perpendicular to the cam finger when the dead bolt is in an unlocked position.

17. The storm door of claim 13 further comprising first and second escutcheon plates, the first spindle being between the first and second escutcheon plates, the key cylinder operatively linked to the first spindle, and a thumb turn operatively linked to the key cylinder by the first spindle.

18. The storm door of claim 17 wherein the key cylinder, cam and thumb turn are operatively linked so that the length of the first spindle can be altered to allow the lock to be placed in a door body of varying thickness.

19. The storm door of claim 18 wherein the first spindle is operatively linked to the cam by fitting through a hole in the cam.

* * * * *